US006050192A

United States Patent [19]

Kipphan et al.

[11] Patent Number: 6,050,192

[45] **Date of Patent: *Apr. 18, 2000**

[54] PROCESS AND ARRANGEMENT FOR CONTROLLING OR REGULATING OPERATIONS CARRIED OUT BY A PRINTING MACHINE

[75] Inventors: Helmut Kipphan, Schwetzingen; Wolfgang Geissler, Bad Schoenborn; Gerhard Fischer, Sinsheim; Werner Huber, Rauenberg; Bernd Kistler, Eppingen; Gerhard Loeffler, Walldorf; Anton Rodi, Leimen; Harald Bucher, Eschelbronn; Clemens Rensch, Heidelberg, all of Germany

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/571,858

[22] PCT Filed: Jun. 27, 1994

[86] PCT No.: PCT/EP94/02078

§ 371 Date: Apr. 29, 1996

§ 102(e) Date: Apr. 29, 1996

[87] PCT Pub. No.: WO95/00336

PCT Pub. Date: Jan. 5, 1995

[30] Foreign Application Priority Data

Jun. 25, 1993 [DE] Germany ..... 43 21 179

[51] Int. Cl.[7] ..... B41F 5/16

[52] U.S. Cl. ..... 101/232; 101/181

[58] Field of Search ..... 101/181, 248, 101/232; 347/232; 364/469; 250/561

[56] References Cited

U.S. PATENT DOCUMENTS

| | | | |
|---|---|---|---|
| 4,088,074 | 5/1978 | Dahlgren et al. | 101/350 |
| 4,186,309 | 1/1980 | Gnuechtel | 250/561 |
| 4,197,584 | 4/1980 | Blazek . | |

(List continued on next page.)

FOREIGN PATENT DOCUMENTS

| | | |
|---|---|---|
| 0 127 831 | 12/1984 | European Pat. Off. . |
| 0194331 | 9/1986 | European Pat. Off. . |
| 0 277 329 | 8/1988 | European Pat. Off. . |
| 0436818 | 7/1991 | European Pat. Off. . |
| 0444427 | 9/1991 | European Pat. Off. . |
| 0 576 824 | 1/1994 | European Pat. Off. . |
| 0649743 | 4/1995 | European Pat. Off. . |
| 32 32 490 | 3/1983 | Germany . |
| 33 24 951 | 1/1985 | Germany . |
| 3714011 | 2/1988 | Germany . |
| 38 15 533 | 11/1989 | Germany . |
| 40 23 414 | 2/1991 | Germany . |
| 39 32 932 | 4/1991 | Germany . |
| 4023314 | 1/1992 | Germany . |
| 4136461 | 5/1993 | Germany . |
| 196 04 241 | 8/1996 | Germany . |
| 2 107 047 | 4/1983 | United Kingdom . |
| 89/01867 | 3/1989 | WIPO . |

OTHER PUBLICATIONS

Publ. Der Polygraph 8–86, p. 928, "Die nichtkonventionellen Druckverfahren" (The unconventional printing method).

*Primary Examiner*—John S. Hilten
*Assistant Examiner*—Charles H. Nolan, Jr.
*Attorney, Agent, or Firm*—Herbert L. Lerner; Laurence A. Greenberg; Werner H. Stemer

[57] ABSTRACT

A process and arrangement are disclosed for controlling or regulating operations carried out by a printing machine.

14 Claims, 5 Drawing Sheets

U.S. PATENT DOCUMENTS

| | | | |
|---|---|---|---|
| 4,438,694 | 3/1984 | Parkins et al. | 101/152 |
| 4,453,463 | 6/1984 | Dahlgren et al. | 101/148 |
| 4,470,074 | 9/1984 | Yamada . | |
| 4,484,522 | 11/1984 | Simeth | 101/181 |
| 4,546,700 | 10/1985 | Kishner et al. | 101/181 |
| 4,561,103 | 12/1985 | Horiguchi et al. . | |
| 4,660,158 | 4/1987 | Zingher . | |
| 4,736,680 | 4/1988 | Wales et al. . | |
| 4,900,148 | 2/1990 | Doerr . | |
| 4,932,320 | 6/1990 | Brunetti et al. | 101/181 |
| 4,934,821 | 6/1990 | Morton | 358/102 |
| 4,982,413 | 1/1991 | Hauck et al. . | |
| 5,056,430 | 10/1991 | Bayerlein et al. | 101/181 |
| 5,076,163 | 12/1991 | Sainio et al. | 101/181 |
| 5,117,365 | 5/1992 | Jeschke et al. | 101/248 |
| 5,138,667 | 8/1992 | Roch et al. | 101/181 |
| 5,187,376 | 2/1993 | Hashimoto et al. | 250/562 |
| 5,258,925 | 11/1993 | Maier et al. | 364/526 |
| 5,313,570 | 5/1994 | Dermer et al. | 395/191 |
| 5,327,826 | 7/1994 | Rodi | 101/181 |
| 5,357,448 | 10/1994 | Stanford | 364/526 |
| 5,412,577 | 5/1995 | Sainio et al. | 364/469 |
| 5,689,425 | 11/1997 | Sainio et al. | 364/469.03 |
| 5,748,221 | 5/1998 | Castelli et al. | 347/232 |

5
6
3
4
8
13
21
17
19
23
26
28
11
15
2
27
12
29
16
1
M
7
10
24
25
9
14
20
18
22
40
39
41
42
38
34
32
37
35
47
36
46
45
33
44
31
30
43

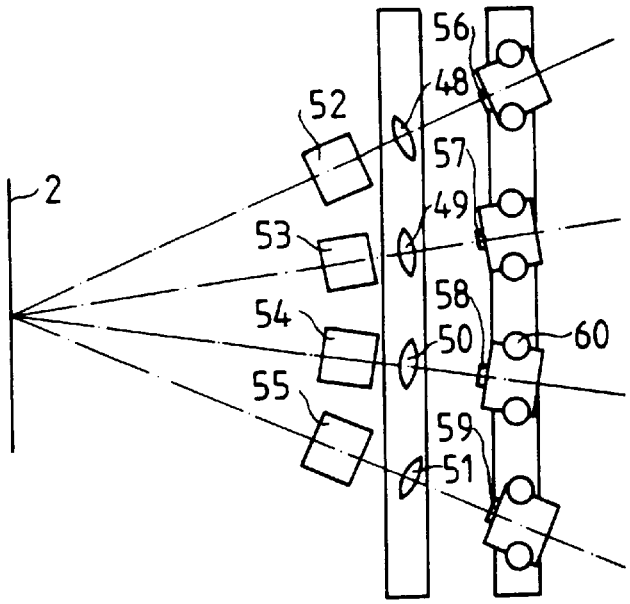
Fig. 2
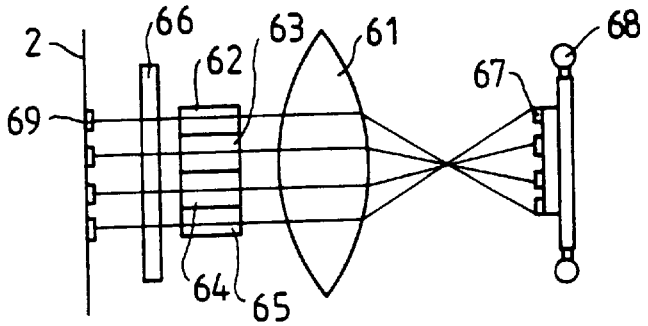
Fig. 3
Fig. 4
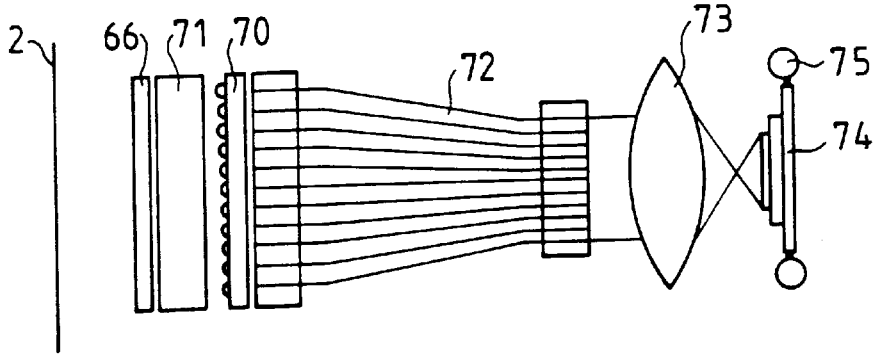

PROCESS AND ARRANGEMENT FOR CONTROLLING OR REGULATING OPERATIONS CARRIED OUT BY A PRINTING MACHINE

The invention relates to a process and an apparatus for the open-loop control or closed-loop control of operating actions of at least one printing machine. The invention is applicable particularly in printing presses that contain devices for the handling, printing and treatment of sheets or other surfaces to be printed. Furthermore, the invention is applicable for the open-loop control or closed-loop control of devices that are positioned before or after a printing press, such as devices for the singling, folding, cutting, collecting, stacking, inserting, sorting and deposition of sheets or webs. Further areas of application are machines and devices for the bookbinding production and further treatment of printed products as well as devices for the inspection of printed products that permit, inter alia, the visual representation of the surface and/or a quality assessment of the printed products. The invention is used for the open-loop control and closed-loop control of operating actions that essentially influence the shaping and/or inking of a sheet, web or printed product.

The prior art comprises processes and apparatuses for the open-loop control and closed-loop control of operating actions on printing presses followed by cutting and folding devices. For the open-loop control and closed-loop control of inking and of the cutting and folding register, coloured colour-control strips, register crosses and other register marks—in addition to the actual printed image—are produced on the surface of the printing substrate as a sheet or a web is transported through the printing units.

For inking control, it is known, on the basis of colour measurements in colour fields of a specific colour of the colour-control strip, to obtain actual values for the inking control. It is also known, particularly in the case of decorative and special inks, to obtain actual values for inking control from image areas printed in full tones. Colour measurement in the colour fields or in the full-tone image areas may be carried out inside the printing press or off-line outside the printing press, for which purpose an inspection sheet is diverted out of the process and is supplied to a colour-measuring arrangement. The preferably optoelectronically obtained measured colour values may be passed on to an open-loop and closed-loop control circuit, where they are compared with setpoint values and are converted into manipulated variables for actuating elements of an ink-distribution apparatus.

Known for register adjustment are apparatuses that comprise on-line register-mark sensors which are directed at register marks that have been co-printed in register-mark tracks. Likewise, there are off-line apparatuses in which the register accuracy of register crosses is measured with a register-cross reader and the measured values are subsequently passed on to said printing-press control, where manipulated variables are generated for the register-adjusting devices.

A disadvantage of these solutions is that the measurement sites for determining the actual values of the operating variables to be controlled are fixed by the colour-measurement fields, register crosses and register marks (which serve the purpose of quality control). The production of these measurement marks requires considerable effort at the pre-press stage.

The accuracy of such colour-measurement fields and register crosses is limited by mounting, copying and developing errors at the pre-press stage. Furthermore, the colour-control strips and register crosses, which are not part of the actual printed image, restrict the area available for the printed image on the printing substrate. The colour-measurement fields of a colour-control strip, which is usually positioned before or after the actual printed image as viewed in the transport direction of the printing substrate, are representative only to a limited extent of the printed image. The off-line colour measurements delay the inking-control process, a quantity of waste being produced until an okay state is reached. Undefined instants of pulling, particularly when the printing press is not in a steady-state condition, lead to problems, such as overshooting in inking control. Furthermore, the existing solutions are inflexible with regard to the choice of the colour-measurement site. The subject-dependent selection of the colour-measurement site by the operator of the printing press is not provided for in the solutions according to the prior art. Furthermore, off-line colour measurement means that the operator is involved over a lengthy period of time with the handling of the measurement objects and the colour- and register-measuring apparatus. Consequently, the operator does not have at his disposal complete information on the trends with regard to inking and register adjustment.

Since separate actual-value-obtaining sensors must be provided for each of the various operating actions to be controlled, there is an increase in the effort and costs required for the open-loop control and closed-loop control of simultaneously more than two operating actions.

The object of the invention is to develop a process and an apparatus that assist and supplement the operator in the performance of quality-control functions, that make it possible to select a representative colour-measurement site either manually or automatically, that guarantee rapid control, that reduce the quantity of waste produced and that lessen the effort and costs with regard to the open-loop control or closed-loop control of operating actions of a printing machine.

The object of the invention is achieved by a process in which coordinates for the measurement sites of an image-recording apparatus are determined from image information reproducing at least the surface of a printed product. At each measurement site, the image-recording apparatus measures a measurement field of defined size from the surface of a printed product.

The apparatus according to the invention for the open-loop control or closed-loop control of operating actions of a printing machine with which the process can be implemented consists of at least one image-recording apparatus, said image-recording apparatus being directed at the surface of the printed product and being connected to an open-loop and closed-loop control circuit. The open-loop and closed-loop control circuit is adapted to be supplied with image information reproducing the surface of the printed product. In order to influence the operating actions inside the printing machine, the open-loop and closed-loop control circuit is in communication with actuators.

Embodiments of the invention are contained in the subclaims.

The operating principle of the invention is to be described hereinbelow:

First of all, the coordinates for the measurement sites of the image-recording apparatus are determined, by means of the open-loop and closed-loop control circuit, from the image information reproducing the surface of a printed product. The image information for the determination of the coordinates may come from various sources. A first possibility consists in that the image information is taken from the image-recording apparatus, said image-recording apparatus being disposed in the printing machine and, for scanning, being directed at the surface of a printed product. For this purpose, either the entire surface or only partial regions thereof may be scanned.

If the printing machine is a printing press and the image-recording apparatus, preferably following a last printing unit, is directed at the surface of a sheet or a web, then the image information for determining the coordinates for the measurement sites may be obtained from a printed image produced during the setting-up phase. Since the image-recording apparatus records not only the printed image but also the remaining area of the sheet or web, it is possible to employ the process or apparatus for the purpose of material identification or material testing of the printing substrate, particularly in order to determine the whiteness or the degree of luminescence or in order to determine inking fluctuations or material defects, such as flaws or holes.

If the printing machine is provided exclusively for the inspection of printed products, then the image information may, with the aid of the image-recording apparatus, be obtained from the surface of any printed product that is to be inspected.

A further possibility for determining coordinates for the measurement sites consists in the use of image information taken from an image-recording apparatus that scans an image of the surface of the printed product outside the printing machine. Further possibilities result in that the image information is generated with the aid of a digital computer, said digital computer being a constituent part of an apparatus for image generation, or in that the already existing image information is taken from a data memory.

The selection of a suitable measurement site for a defined operating action may be accomplished with the aid of a computer, said computer possibly being disposed inside the open-loop and closed-loop control circuit. If, in an offset printing press, for example, it is desired that the inking, damping-solution supply and register are to be closed-loop- or open-loop-controlled, then coordinates are determined for the measurement sites of each of these operating actions.

Executed in the computer is a program that finds the suitable measurement sites. For the inking control of a printing press, the image information may be used, for example, automatically to determine measurement sites situated in a colour-control strip and/or situated in the printed image itself. Said program ensures that the measurement site is significant for determining the actual values of one or more defined colours. For the inking control of a printing press., a measurement site is significant if it contains as much colour information as possible with respect to the colour in question. Suitable measurement sites for inking control are found, for example, inside dark grey-areas. In the case of decorative and special inks, the measurement sites are situated in solo colours, preferably in the ¾ tone region. With regard to the determination of the measurement sites, it is possible to take account of particularly critical tones, with the result that, for example, the measurement site for a subject showing furniture is situated in a brown-coloured region or, in the case of a portrait, is determined in a flesh-coloured region. The information on which is the critical colour for the print in question can be entered beforehand into the apparatus according to the invention.

Determined for damping-solution control are those significant measurement sites that are situated in ink-free areas (as viewed in the scanning direction) after ¾ tone areas or full-tone areas.

Suitable measurement sites for register control may be found in the printed image with register-cross-like structures, such as thin lines and sharp edges, as exist, for example, in the representation of masts, antennas or windows in a subject.

In a further step, in order to obtain actual values, the printed products are scanned at the predetermined measurement sites using the image-recording apparatus disposed in the printing machine. The actual image signals are supplied to the open-loop and closed-loop control circuit, where they are compared in a comparator with setpoint values from a reference-variable transmitter. For each operating action that is to be controlled, separate actual values are determined at defined measurement sites and are compared with separate setpoint values. For each printing machine, only one image-recording apparatus is required for obtaining actual values for all operating actions requiring control. For each operating action, the open-loop and closed-loop control circuit may contain separate apparatuses, comparators and reference-variable transmitters. It is possible for there to be one common open-loop and closed-loop control circuit for a plurality of printing machines each provided with an image-recording apparatus, a switchover device in this case receiving the actual image signals from the individual image-recording apparatuses and distributing the actuating signals to the individual actuators in order to influence the operating variables. In each case, the open-loop and closed-loop control circuit outputs control signals that influence the particular operating action in the desired manner.

The open-loop and closed-loop control circuit may be accommodated in an operator console and may be implemented in conventional analogue and digital circuit technology or with fuzzy logic. The operator may interact with the open-loop and closed-loop control circuit, for which purpose the operator console may be associated with a computer with a high-resolution screen, an alphanumeric keyboard, a cursor-control apparatus and an input/output device for data.

The screen may display the image from the surface of a printed product including the measurement sites as determined by the open-loop and closed-loop control circuit, it being possible for the measurement sites to be specially marked. Likewise, the screen may display an actual image, a differential image, measured values of operating variables and manipulated variables. The operator is able to intervene in the control of the operating actions by changing the coordinates of the measurement sites, the setpoint values of operating variables or the manipulated variables.

The image-recording apparatus may be directed at a printed product that is guided in a plane or that is transported on the outer cylindrical surface of a cylinder. It is possible in this manner for the operating actions to be controlled not only as a function of image signals coming from the surface of the printed product but also as a function of image signals coming from the surface of the apparatuses transporting the printed products. An example that may be mentioned is that of a gripper control, which controls the opening times of the grippers on the basis of the image signals, said image signals containing the position of the printed product in relation to the grippers that hold the printed product in the transport apparatuses. Usable as the image-recording apparatus are all image sensors suitable for photometric measurements, such as discrete colour-selective photodiodes and transistors, in-line and matrix-configured CCD light detectors or colour-image pick-up tubes. The working wavelength depends on the type of image sensors used, with the result that it is possible to employ both heat radiation, IR radiation, visible light or UV radiation as well as the radiation containing the image information. The image-recording apparatus may operate in reflected-light or transmitted-light mode. The angles of incidence and reflection for the measuring light are adapted to the reception characteristics of the image sensors. The image-recording apparatus is suitable for scanning the entire width of the printed product. A favourable variant consists in a measuring bar that is disposed across the entire width of the printed product, there being simultaneously present both image signals from the actual printed image and also signals from register crosses or register marks and from the regions between the printed image and the edges of the printed product. If necessary, individual image sensors may be desensitized. A further design variant results from an image-recording head that is disposed in transversely traversing manner with respect to the transport direction of the printed product, for which purpose the image-recording head is connected to a positioning apparatus including drive system as well as length- and angle-measuring system. In this manner, the image-recording apparatus may be directed at a defined scanning track containing significant image elements or the register crosses. The changing of the scanning angle, just like a focussing motion, may be automated with the aid of separate closed-loop control devices, with the result that there is always an optimal signal-noise ratio. It is possible to provide an arrangement for the compensation of errors caused by glare, such arrangement being placed in front of the image sensors, for example, in the form of crossed linear polarizers.

With reference to the open-loop or closed-loop control of operating actions on a printing press, further advantages of the invention are to be described hereinbelow:

A particular advantage of the invention is that, with the aid of the aforedescribed image-recording apparatus, it can be used very flexibly for print-quality control. The principal application in the case of a printing press consists in simultaneous image inspection and inking control, for which purpose the image-recording apparatus records measured colour values directly from the printed image. The measured colour values are preferably obtained by photometric means according to the three-region method or with the aid of a spectrally measuring apparatus. The spectral sensitivity of the measuring channels disposed in the image-recording apparatus for each region corresponds to the spectral-value curves of a standard observer. The image sensors themselves may have a defined spectral sensitivity or image sensors of essentially identical sensitivity are adapted by means of filters to the spectral-value curves of the standard observer. Disposed, for example, in a row, the image sensors may scan the printing substrate zone by zone, the zone width possibly being variable, for which purpose signals from image sensors may be captured appropriately in groups. The scanning zones may correspond to the zones specified by the ink-distribution apparatus of the printing press. If, for subject-related reasons, a scanning zone does not contain a suitable measurement site for one or more colours, then measured values from adjacent zones may be used for inking control. It is possible to capture the complete printed image with the image-recording apparatus. However, it is also possible for just a portion of the printed image to be scanned. A special apparatus ensures that the same scanning site is captured in each printed copy. For this purpose, stored image-measurement values may be taken from previous measurement cycles, this making it possible for the scanning site to be detected. In order to determine the scanning site, it is possible, as described above, to use signals from apparatuses for measuring the position of the printing substrate in relation to a reference site, said signals being supplied to the closed-loop control circuit, with the result that there is a correlation between the measured position values and the image signals.

In order, in the case of high-contrast printed images, to prevent under- or over-activation of the image sensors, it is possible for a light-attenuation arrangement to be positioned in front of the receivers. Furthermore, the intensity of the measuring light can be regulated as a function of the speed of the printing substrate or of the contrast at the measurement site, for which purpose suitable devices for speed measurement or for contrast measurement must be in communication with the measuring-light source. The speed may be obtained from the signals of an incremental rotation-position sensor connected to the cylinders transporting the printing substrate.

If CCD lines or matrixes are used as photoelectric receivers in the image-recording apparatus, then it is possible, with the aid of a timer circuit to which the signals of the incremental rotation-position sensor are supplied, for the integration time of the CCD receiver elements to be varied as a function of the speed of the printing substrate or of the printing press.

The image-recording apparatus may in identical manner also detect a colour-control strip that is co-printed outside the actual printed image. In this case, the printed-image sensors are initiated precisely at the time of passing of the colour-control strip. In a variant, the image-recording apparatus may be used to obtain both signals from the actual printed image and also from the colour-control strip.

A further application for the invention consists in that some of the elements belonging to the apparatus are used for image inspection. This makes it possible to achieve overall quality control. For this purpose, the image-recording apparatus is used as an on-line measuring arrangement. As is also the case with on-line colour measurement, a comparison of the actual image data with reference variables is used to determine coarse colour deviations and register errors, scumming, slurring and ghosting as well as other errors, which are then displayed on the screen. Furthermore, image inspection measuring the entirety of the printing substrate makes it possible to detect errors in and on the printing substrate, such as tears, holes, edge irregularities of the printing substrate, inclusions, hickies and printing errors caused by other extraneous mechanical effects. The signals of the comparison resulting from the image inspection are, where possible, supplied to actuators of the printing press in order to influence various operating actions and/or are supplied to apparatuses for the purpose of display and/or quality documentation.

An example of image inspection is the monitoring of the damping-solution supply in an offset printing press. For this purpose, for example, the image data obtained with the image-recording apparatus from the region of the print start can be evaluated continuously across the entire width of the printing substrate. If the evaluation shows that the smear limit has been reached, then the damping-solution distribution apparatuses and, if applicable, the ink-distribution apparatuses are readjusted such that the ink/damping-solution equilibrium permits an optimal production run.

A further example of image inspection is the monitoring of the application of varnish and powder on the printing substrate. For this purpose, the image-recording apparatus is in the form of a gloss-measuring apparatus. It is possible to provide a separate glare source for glare measurement, said separate glare source illuminating the printing substrate at a defined angle of incidence. Likewise, it is possible, for glare measurement, to employ at least one receiver disposed in the image-recording apparatus in order to evaluate light whose plane of incidence and reflection is not in the transport direction of the printing substrate. It is possible in this connection to employ the light source and receiver arrangement used for colour measurement or for image inspection, the secondary light that strikes a receiver being measured.

A further application of the invention in a printing press is that of closed-loop register control. In this connection, actual image signals from register crosses, register marks or from other image elements of significance for the register are evaluated and compared with setpoint image signals.

A closed-loop register-control apparatus outputs signals to register-adjusting elements which cause a correction of the register both with regard to the image position in relation to the edges of the printing stock and also with regard to the individual colour images in relation to each other.

With the aid of the printing-press control system it is possible to select from the above-described applications. Likewise, it is possible not to perform all measurements on each printed image. For reasons of data processing, it may be advantageous, for example, to carry out the image inspection on each printed copy, whereas the colour and register measurements are performed on every second or n-th printed copy and/or an average value is formed over a plurality of printed copies. Likewise, it is possible to vary the number of measurement sites on a printed copy and the frequency of the measurements at a measurement site. It is also possible to switch between these applications depending on process variables. If, for example, the deviation in one of the applications is too high, then the printing-press control system can ensure that, in that application, particularly many actual values are generated with the image-recording apparatus. Such a case may apply, for example, when the printing press is started up or in the case of deviations owing to ghosting.

In order to transmit the signals reproducing the image, it may be advantageous to employ an optical image conductor, the light-entry surface of which is divided into sub-surfaces, the sub-surfaces picking up light from the printing substrate from individual scanning zones. In this case, the light-exit surface is provided with photoelectric receiver elements, which are each associated with one of the scanning zones and which convert the luminous flux into electric signals.

In any case, the signals generated by the image-recording apparatus are supplied to an apparatus for the conditioning of the image signals. The transmission of the image signals between image-recording apparatus and the conditioning apparatus may also be effected in wireless manner without image-conductor cables if the information picked up by the image sensors is relayed via an electromagnetic, acoustic or optical transmitting and receiving link. Such a transmission link is not necessary if the conditioning apparatus is locally associated with the image-recording apparatus. The apparatus for the conditioning of the image signals permits a reduction of the data, depending on the operating mode of the image-recording apparatus, with the result that an optimal controller acting time is guaranteed.

The conditioned image signals are supplied to the comparison apparatus and are compared with reference signals, which may be taken from a reference-variable transmitter. It is possible to use as the reference-variable transmitter a memory containing setpoint image data relating to an earlier printing job for the same printed image. Likewise, it is possible for the memory to contain setpoint image data obtained from the measurement of an okay sheet with all colours and/or from single-colour separations of an okay sheet. Such a measurement needs to be performed once only, for which purpose the printing-press control system may contain a program that, in response to a control signal, delivers the necessary colour separations and causes the measurements to be performed. For example, the area coverages of the individual colours are calculated from the measured values according to the measuring grid and are stored in the memory together with the colour setpoint values from the colour measurement on the okay sheet. Likewise, the reflectances of the individual colours may be measured and stored, this dispensing with the need for the conventional, empirical determination and storage of colour tables. This method of providing reference variables is of advantage particularly when printing with more than the four process colours, cyan, magenta, yellow and black, only one image-recording apparatus being required for a printing press. In order to improve the accuracy of calculation in the solution of the in this respect customary Neugebauer equation, it is also possible for colour separations for any desired colour combinations, such as black/cyan; black/magenta; black/yellow; cyan/magenta; cyan/yellow and magenta/yellow, to be printed, measured and their reflectance stored.

The production and measurement of colour separations is also advisable in the case of calculation methods that work without knowledge of the area coverages, e.g. only with reflectances or with calorimetric or density values calculated therefrom. Thus, this possibility of providing reference variables is not limited to the determination of the area coverage and may make available all required knowledge concerning individual colours and various combinations thereof.

Another possibility of providing reference variables consists in that the reference signals are taken from an image-measuring device on which an accurately positioned original has been scanned. The off-line image-measuring device and the on-line image-recording apparatus may be of identical type. It is also possible for part-images of an accurately positioned original to be scanned as the original, the reference-variable transmitter in this case being adapted to be supplied with layout signals for the positioning of the part-images and how they are to be disposed on the accurately positioned original.

A further possibility of providing reference variables results in that the operator of the printing press sends a data-acceptance signal to the reference-variable transmitter when the operator, visually and on the basis of measured values, makes the decision that the printing press has attained a production-run state consistent with the required quality. In this case, the conditioned actual image signals are transmitted as setpoint values to the reference-variable transmitter.

In a variant, it is possible to provide an apparatus that evaluates the time intervals and magnitudes of the actuating signals given interactively by the operator. If the intervals between the actuating signals and the magnitudes fall below threshold values, then this apparatus makes it possible to generate a signal for the okay state. As a result of this signal, the actual values can be adopted as setpoint values, with the result that the instantaneously pertaining, production-run-compatible process conditions are frozen until the operator of the printing press sends the aforementioned signals at shorter intervals to the closed-loop control circuit.

Furthermore, the reference signals may be taken from a setpoint-value memory associated with the control apparatus of the printing press. Usable as the setpoint-value memory are all conventional data-processing storage media, such as semiconductor memories, diskettes, magnetic tapes and optical storage devices. The reference signals can be corrected or changed manually by the operator. Likewise, the operator has the option of changing the reference signals globally on a percentage basis.

If, as the result of the comparison between setpoint values and actual values, the output signal deviates from a limit value, then it is possible for an error signal to be generated and output. A variant consists in that an acoustic signal is output. If a computer with alphanumeric keyboard and cursor-control apparatus as well as with a screen is provided for interaction of the operator with the printing-press control system and with the inking controller, then the error signal can be generated visually on the screen, it being possible for the actual image and the specially marked errored image areas to be displayed on the screen. The markings of the errored image areas may, for example, be simple geometrical figures or may be implemented in the form of a visually easily visible false-colour representation. Apart from the graphical representation of the errors, it is possible—if the closed-loop control circuit is associated with an error-detection logic circuit—for the error type to be determined from the conditioned image signals or from the signals after the comparator apparatus and for it likewise to be displayed on the screen. The errors may be classified, inter alia, into the following error types: inking errors, register errors, damping-solution-supply errors, hickies, flaws in the printing substrate, impurities in the printing substrate and edge irregularities in the printing substrate. The closed-loop control apparatus may be disabled as a function of the output signal from the error-detection logic circuit. In this manner, it is possible, for example, to prevent a flaw or an impurity in the printing substrate from having any impact on the inking control. Likewise, it is possible to check the plausibility of the actual values for the closed-loop control apparatus and to examine their suitability for inking control and image inspection, this being accomplished in that the spread of the measured values of image points for colour measurement is calculated and is monitored for the exceeding of a limit value.

Likewise in a sheet-fed printing press, the exceeding of the limit value for the difference between setpoint image values and actual image values may result in the incorrectly printed sheets being separated out at a waster diverter, it being possible, as an alternative, to provide a marking device, such as an ink-jet printing device, that marks the defective sheets or parts of the sheet in question.

For the quality control of a printing job, the setpoint/actual deviation may be documented at intervals. For example, an above-described marking device may be used to print every 50th sheet or printed image with a serial number, the time of measurement and the magnitude of the setpoint/actual deviation. In the case of a sheet-fed printing press, a tape inserter at the delivery pile may be actuated simultaneously. In addition, the quality-documenting data printed on the sheets may be stored and, as and when required, be output as a report with error statistics. The measured data from the inspection sheets may be checked once again outside the printing press with the aid of a calibrated colour-difference measuring apparatus preferably at homogeneous measurement sites on the printed image.

Hereinbelow, the invention is to be explained in greater detail with reference to the drawings, in which:

FIG. 2 shows an image-recording apparatus with four different imaging systems;

FIG. 3 shows an image-recording apparatus with precisely one optically imaging system;

FIG. 4 shows an image-recording apparatus with a lens array;

Figure 1:
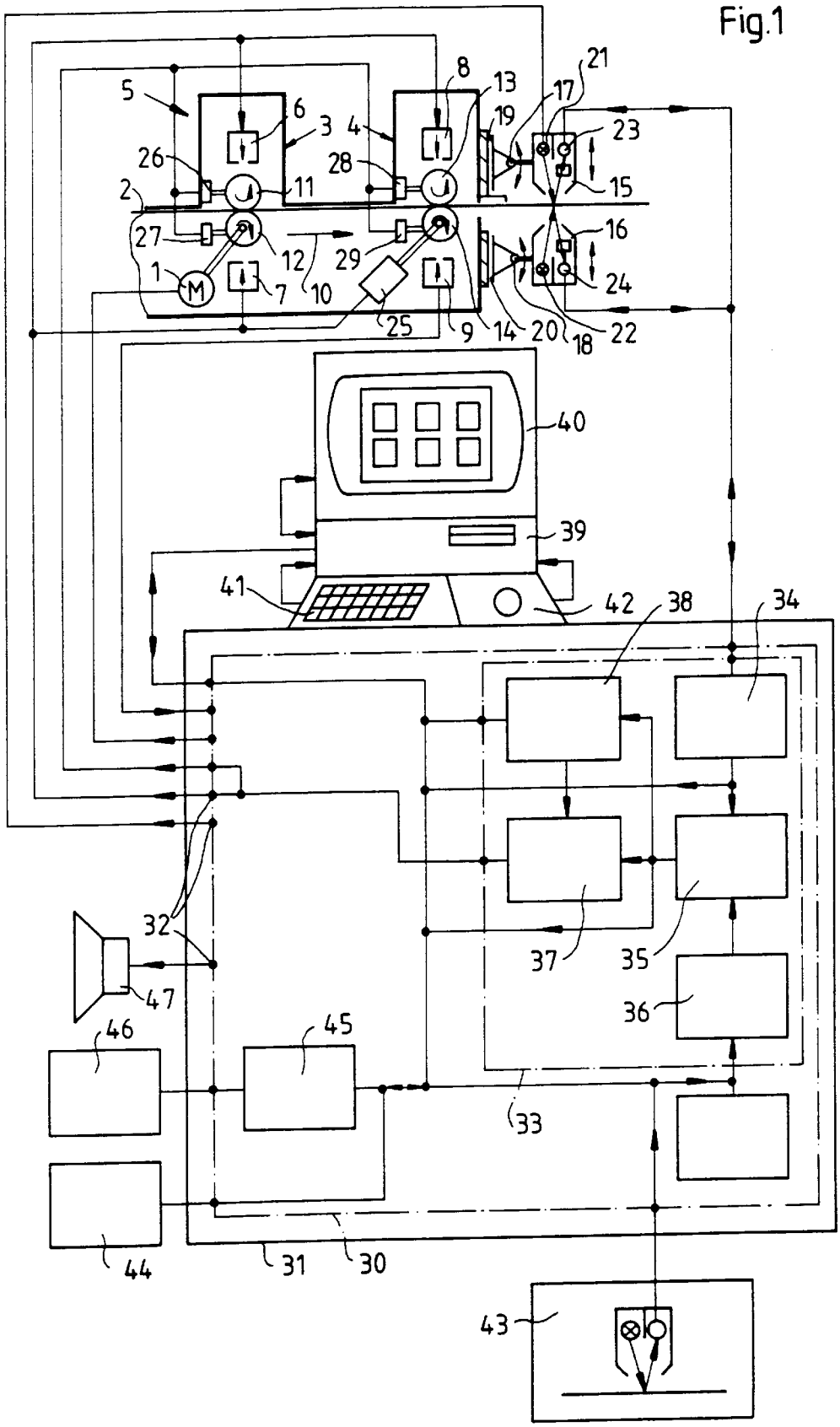
FIG. 1 shows a diagram of an open-loop or closed-loop control apparatus according to the invention for a printing press.

In the diagram of an inking-control system according to the invention shown in FIG. 1, a web 2 is transported by means of driving elements 1 for two-sided printing by printing units 3, 4 of a web-fed rotary printing press 5. The printing units 3, 4 contain ink-distribution apparatuses 6, 7, 8, 9 which contain conventional zonal ink-metering elements and which produce a defined colour profile in the transverse direction to the transport direction 10 of the web 2. In contact with pressure-set blanket cylinders 11, 12, 13, 14, the web 2 is multi-colour-printed on both sides in one pass through the web-fed rotary printing press 5. Following the last printing unit 4, provided on each of the top and bottom sides of the web 2 is an image-recording apparatus 15, 16, said image-recording apparatuses 15, 16 being swivellable in bearings 17, 18 and being displaceable in guides 19, 20 perpendicularly to the transport direction 10. The image-recording apparatuses 15, 16 cover the entire width of the web 2 and each contain at least one light source 21, 22 and a multiplicity of photoelectric receivers 23, 24. In order to measure the rotational speed and the rotation angle of the blanket cylinders 11, 12, 13, 14 as well as the transport speed of the web 2, one of the blanket cylinders 11, 12, 13, 14 (which are connected through the intermediary of a gear train) is connected to an incremental rotary-position sensor 25. The phase of the blanket cylinders 11, 12, 13, 14 can be changed with the aid of register-adjusting devices 26, 27, 28, 29. All the elements required for the open-loop control and closed-loop control of the operating actions of the web-fed rotary printing press 5 are connected to a printing-press control system 30, which is disposed in an operator desk 31. The printing-press control system 30 contains input and output points 32 for open-loop and closed-loop control signals. The connections and arrows to the input and output points 32 shown in FIG. 1 show schematically the flows of information and the directions thereof. In addition, the printing-press control system 30 contains the hardware and software as well as at least one closed-loop control circuit 33. The closed-loop control circuit 33 contains, inter alia, an apparatus 34 for the conditioning of the image signals, a comparator 35, a reference-variable transmitter 36, a closed-loop control apparatus 37 and an error-detection logic circuit 38. The apparatus 34 for the conditioning of the image signals is in communication with the photoelectric receivers 23, 24 of the image-recording apparatuses 15, 16. The output of the apparatus 37 for the conditioning of the image signals is connected to an actual-value input of the comparator 35, a setpoint-value input of the comparator 35 being in communication with the reference-variable transmitter 36. The output of the comparator 35 is in communication with one input each of the error-detection logic circuit 38 and the closed-loop control apparatus 37. A control output of the error-detection logic circuit 38 is connected to a blocking input of the closed-loop control apparatus 37. The output of the closed-loop control apparatus 37 is connected through the intermediary of an output point 32 to the ink-metering elements in the ink-distribution apparatuses 6, 7, 8, 9. The output of the closed-loop control apparatus 37 is further adapted to be connected to the register-adjusting devices 26, 27, 28, 29. Disposed on the operator desk 31 is a computer 39 with a screen 40, a keyboard 41 and a cursor-control apparatus 42. The bus system of the computer 39 is routed via a further input/output point 32 to the printing-press control system 30. Adapted to be connected to the bus system are data from an external image-measuring device 43, data from a computer network 44 of the printing shop and data from a data-communication modem 45 as well as the output data from the comparator 35 and the error-detection logic circuit 38. The data-communication modem 45 is connected to an external transmitting and receiving unit 46. An acoustic signal generator 47 is connected to the printing-press control system 30 at an output point 32.

The operating principle of the inking controller shown schematically in FIG. 1 is to be described hereinbelow:

According to the number of ink zones, which are determined by the ink-distribution apparatuses 6, 7, 8, 9, a plurality of light sources 21, 22 are provided in the image-recording apparatuses 15, 16 along a line and evenly distributed across the width of the web 2. By means of elliptic mirrors, the light is cast onto the web 2 at a defined angle of incidence. Each individual light source 21, 22 is energized by a programmable current source, with the result that the colour temperature of the light sources 21, 22 can be regulated. For this purpose, the actual luminous flux from each light source 21, 22 can be detected by means of light-conducting fibres. The measurement light reflected by the web 2 can be transmitted by means of an optically imaging system to the photoelectric receivers 23, 24. The luminous flux emanating from a picture element of the web 2 is proportional to the signal charge of a photodiode of a CCD line used as the receivers 23, 24. For the purpose of calibration and balancing, the image-recording apparatuses 15, 16 are displaceable perpendicularly to the transport direction 10 and are swivellable about the bearings 17, 18. This makes it possible for the image-recording apparatus 15, 16 to be focussed and error-compensated. With the image-recording apparatuses 15, 16 in a swung-out position, it is possible for calibration to be performed with reference to a colour standard. Likewise, it is possible, for the purpose of the balancing of the image-recording apparatuses 15, 16, for the light source 21, 22 or the photoelectric receivers 23, 24 or only some of them to be displaceable in the direction of the optical axis. Since colour measurement in the printed image is carried out according to the so-called three-region method, it is necessary—on account of the differing spectral characteristics of the optical measuring means and of the photoelectric receivers 23, 24 in the individual ink zones—to provide spectrally balancing components in the measurement beam. One method for spectral balancing consists in providing correction-filter glasses in addition to the main filter required for the implementation of the three-region method. Another method employs partial filters, wherein a multiplicity of different colour filters are cemented or sputtered onto neutral glass. Through the additional use of stops and masks, the area portions of the individual colour filters are switched on or off, with the result that the spectral characteristics can—be influenced. In a simple arrangement, four partial filters cemented onto a carrier plate are positioned above a circular stop by means of a cross-slide. In order to prevent temperature errors, the colour filters and photoelectric receivers 23, 24 can be kept at a constant working temperature with a thermostat.

FIG. 2 shows an image-recording apparatus 15, 16 with four different imaging systems 48, 49, 50, 51, in which colour filters 52, 53, 54, 55 are disposed facing the web 2. For the adjustment of CCD sensors 56, 57, 58, 59 (acting as receivers 23, 24) in relation to the imaging systems 48, 49, 50, 51, the CCD sensors 56, 57, 58, 59 are connected to adjusting elements 60.

In the variant shown in FIG. 3, only one optically imaging system 61 is provided, the colour filters 62, 63, 64, 65 being combined to form a block. A protective lens 66 is provided in front of the colour filters 62, 63, 64, 65. Provided as receivers 23 and 24 are four-fold CCD lines 67, which are disposed on a common adjusting element 68. With this optical arrangement, during colour measurement in the individual spectral regions, different image elements 69 are imaged onto the four-fold CCD lines 67, with the result that the measured colour values belonging to an image element 69 arise at different points in time. The spacing of the image elements 69 of the CCD lines 67 and the optical characteristics of the optically imaging system 61 are matched to each other.

FIG. 4 shows an image-recording apparatus 15, 16 with a lens array 70. The image information, weighted by the colour filter 71, is injected into an image conductor 72 with the lens array 70. The optically imaging system 73 situated at the output of the image conductor 72 relays the image information to a CCD sensor 74, which is connected to adjusting elements 75. It is also possible to dispense with the optically imaging system 73 if the glass fibres of the image conductor 72 are connected through the intermediary of a fibre-optic window or directly to the CCD sensor 74. Such an optical arrangement must be provided separately for each process colour used.

Figure 5:
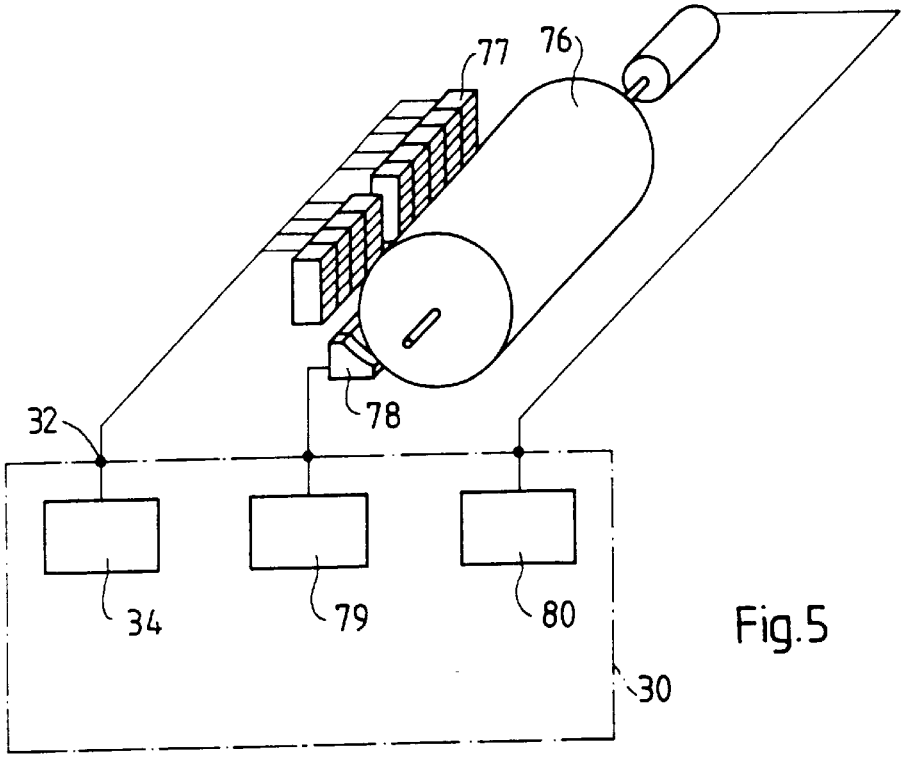
FIG. 5 shows a diagram of a signal being obtained from a cylinder on a sheet-fed printing press.

FIG. 5 shows a diagram of actual signals being obtained from a cylinder 76 of a sheet-fed printing press. The receiver modules 77, which are disposed across the width of the cylinder 76, are connected to the apparatus 34 for the conditioning of the image signals. The light sources 78, which are likewise of modular construction, are connected to an apparatus 79 for light-quantity regulation, which apparatus 79 is likewise accommodated inside the printing-press control system 30. Provided inside the printing-press control system 30 for synchronization and for provision of a pre-processing clock are a synchronization apparatus 80 and a timer, which are connected to an incremental transmitter 81.

Figure 6:
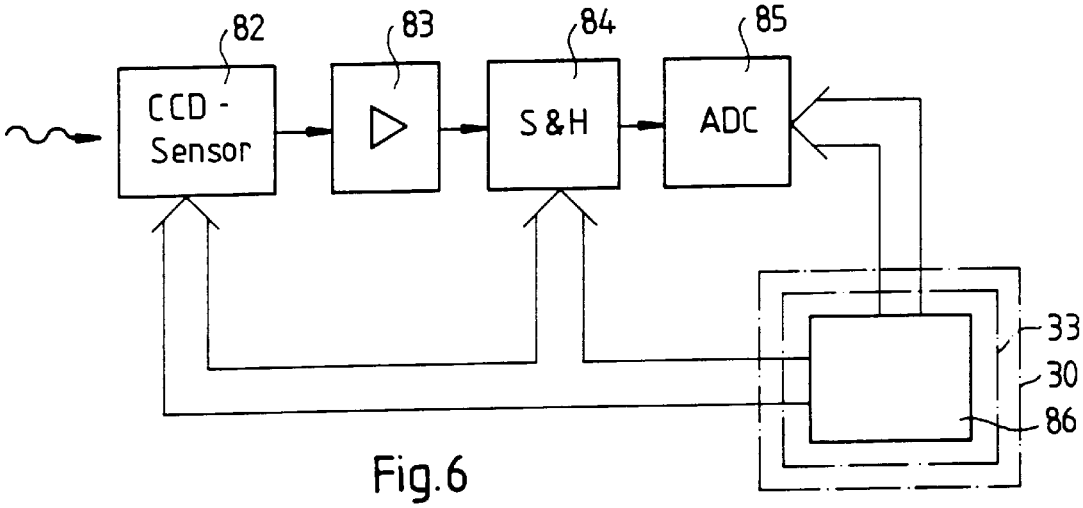
FIG. 6 shows an optoelectronic signal-processing arrangement.

For an image-recording apparatus 15, 16 equipped with CCD sensors 74, the signal conditioning inside the apparatus 34 is to be described hereinbelow:

As shown in FIG. 6, the electric image signals generated by the CCD sensors 82 are supplied consecutively to an amplifier 83, a sample-and-hold element 84 and an analogue-digital converter 85. The output of the analogue-digital converter 85 is connected to a digital processing unit 86, which, inter alia, performs the function of the closed-loop control circuit 33 (described in FIG. 1) inside the printing-press control system 30.

Figure 7:
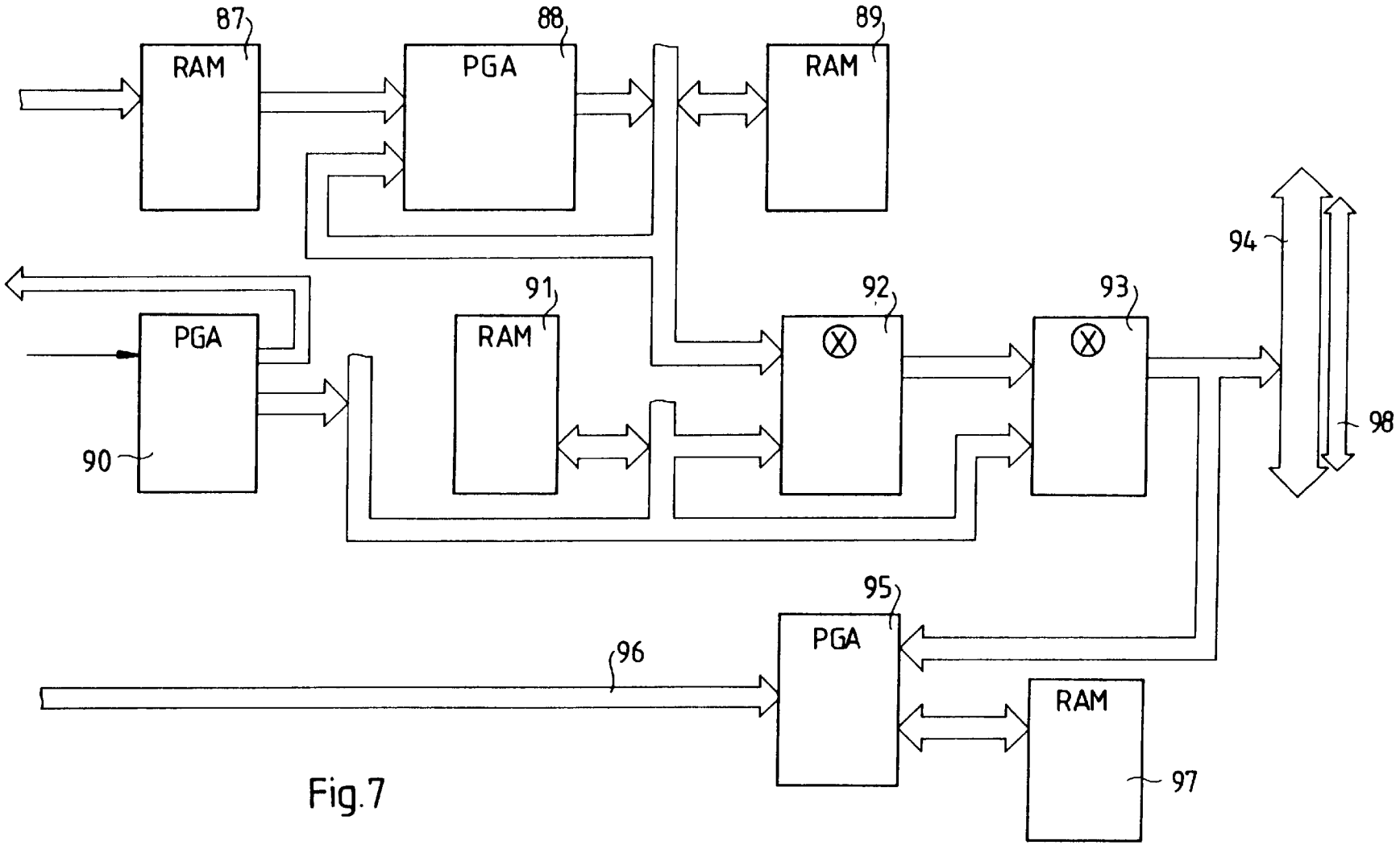
FIG. 7 shows a diagram of the correction and colour-value-signal storage of the image signals.
Figure 8:
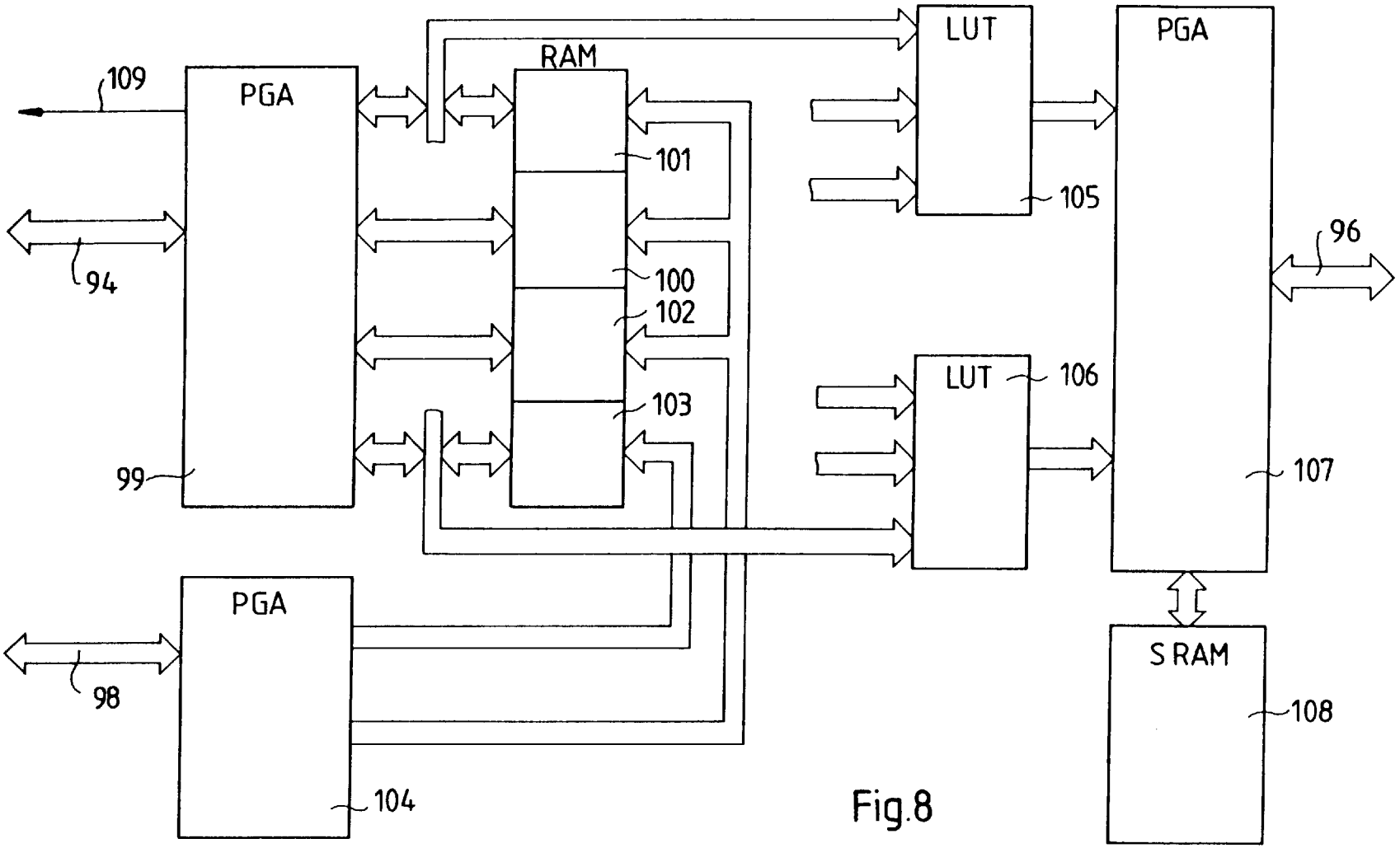
FIG. 8 shows a diagram of differential-image evaluation.

FIG. 7 shows schematically the correction of the image signals and the storage of the colour-value signals and FIG. 8 shows schematically the evaluation of the differential images inside the processing unit 86. From the analogue-digital converter 85 the digital image signals are sent to a first correction element 87 equipped with memory units. Said correction element 87 contains a look-up table for the linearization of the characteristic of the converter elements of the CCD sensors 82. The therefor required data are obtained, when the system is started up, by means of a white-value adjustment at different energization levels of the CCD sensors 82 and are stored in the correction element 87. The corrected image signals are supplied to an input A of an accumulation unit 88. With the aid of the accumulation unit 88, different printing speeds are compensated through controlled pixel-wise addition in conjunction with variation of the integration time of the CCD sensors 82. The intermediate totals are stored in a vertical-format buffer 89, which is adapted to be connected to an input B of the accumulation unit 88. It is guaranteed in this manner that, at the maximum speed of the rotary printing press 5, the CCD sensors 82 are still sufficiently energized, for example with 50%, by the brightest area in the image. At the minimum printing speed, a plurality of measurements are possible within a measuring line, for example eight scanning operations at full energization of a line of CCD sensors 82, with the result that, in this example, there is a maximum compensatable speed ratio of 1:16. At the same time, the accumulation over n scanning operations results in an improvement in the signal-noise ratio at low printing speeds. Accumulation is implemented such that added to the image data of the n-th pixel (present at input A of the accumulation unit 88 with respect to the k-th scanning operation) are the intermediate totals formed during the (k−1)-th scanning operation, read from the vertical-format buffer 89 and supplied to input B of the accumulation unit 88. Then, the new intermediate total is intermediately stored to a memory location n+1. A timer 90 generates from the pulses of the incremental rotary-position sensor 25 or 81 the addresses of the vertical-format buffer 89 and of a list memory 91 and corrects the address offset that arises during the accumulation, with the result that, during the last accumulation within a measuring line, the vertical-format buffer 89 and a shading memory contained in the list memory 91 run in synchronism. The timer 90 continues to deliver the control signals and the multiplex clock for the CCD sensors 82. For example, at a low printing speed, the data from eight lines of the CCD sensors 82 can be multiplexed to the input of the correction element 87. The timer 90 continues to be supplied with signals on the thickness of the printing substrate 2, which signals are obtained by means of a thickness-measuring apparatus or are already available inside the printing-press control system 30. These signals are combined with the signals from the rotary-position sensor 25, with the result that the measured values for speed and position, which are dependent on the thickness of the printing substrate 2, are corrected for the printing substrate 2.

In addition, the processing unit 86 contains a multiplier 92, by means of which the accumulated image data (present at input A) from a last accumulation of a measuring line and the reciprocal values (present at input B) of the normalized integration time are multiplied together.

A multiplier 93, following the multiplier 92, causes the correction of the local intensity of the light sources 21, 22 or 78 in that the output signals from the multiplier 92 are multiplied by the intensity-correction factors stored in the list memory 91. The lists for the multipliers 92, 93 are stored likewise in the list memory 91, which also contains the prediction values for the integration-time control. When the rotary printing press 5 is started up, the shading-correction list, stored in the list memory 91, as well as the characteristic data of the input look-up table are generated in the correction element 87 and are continuously updated during a white-value adjustment by selected non-printed image lines. Present at the output of the multiplier 93 are image data that have been completely corrected with regard to energization, printing speed, shading and sensor characteristic, which image data can be sent synchronously via a pipeline bus 94 for further processing and is supplied parallel thereto to a colour-value controller 95. The colour-value controller 95 is a programmable-gate-array circuit (PGA), which is supplied, through the intermediary of an AT bus 96, with the coordinates of the measurement fields, for example on the web 2. The coordinates of the measurement fields for a defined colour are generated by means of a process previous to the actual inking-control process and are made available on the AT bus 96. Only for these measurement fields is the colour value of a pixel stored in a memory module 97, this being accomplished with the aid of the colour-value controller 95. The respective information is transmitted via control lines 98 of the pipeline bus 94. The memory module 97 contains the data on colour vectors, which are readable via the AT bus 96 for colour measurement. The pixels used for colour measurement are randomly addressable in a fine grid. The measurement geometry can be displaced at will in the fine grid and can be configured such that there is better adaptation to specified measurement geometries.

FIG. 8 shows the further processing of the completely corrected image data from all the ink zones produced on the web 2 and from all modules of the image-recording apparatus 15, 16 disposed transversely with respect to the transport direction 10. According to FIG. 8, a data controller 99, implemented using PGA techniques, is supplied with the corrected actual-image data from the entire surface of the web 2 via the bidirectional pipeline bus 94. The transmission of the actual-image data to the pipeline bus 94 can be carried out in the measurement pauses or in synchronism with the scanning of the web. The data controller 99 is additionally in communication with a setpoint-image memory 100, a differential-image memory 101, a parameter-image memory 102 and an accumulated differential-image memory 103. The loading of the data controller 99 and the selection of the operating modes is effected via the AT bus 96. The memories 100 to 103 are connected to an address controller 104, implemented using PGA techniques, which is connected to the control lines 98 of the pipeline bus 94. For the evaluation of the differential image and of the accumulated differential image, the differential-image memory 101 and the accumulated differential-image memory 103 are each in communication with look-up-table modules 105, 106 (LUT). With the aid of data from the setpoint-image memory 100 and the parameter-image memory 102, the LUTs 105, 106 cause the differential-image data to be transformed to colorimetric LAB values of the LAB colour space. The outputs of the LUTs 105, 106 are in communication with an evaluation circuit 107, likewise implemented using PGA techniques. Connected to the evaluation circuit 107 is a memory module 108, in which are stored, during image measurement, the coordinates of a coarse grid for errored image areas. The data of the evaluation circuit 107 can be read via the AT bus 96.

In a teach-in phase, the data controller 99 and the evaluation circuit 107 are configured such that the setpoint-image memory 100 and the accumulated differential-image memory 103 are combined to form a common memory. In order to generate a setpoint image, a desired number m of accumulations can be entered. Consequently, the corrected image data are multiplexed in the data controller 99, with the result that, after $2_m$ accumulations, the setpoint image is present in normalized form in the setpoint-image memory 100. The data controller 99 acts as an addition element with preceding multiplexer.

If the setpoint- and parameter-image data are already present in an external memory, then this data can be loaded via the pipeline bus 94 with the aid of a Forth processor (not further shown). The enabling of the desired memory area is guaranteed by the address controller 104.

After the data have been generated in the memories 100 to 103, the data controller 99 implements an addition element which generates data for a current differential image from the difference of the actual-image data with the setpoint-image data. In addition, the data controller 99 implements an accumulator, accumulated differential-image data being generated from the sum of the data of an accumulated differential image and of a current differential image. The current differential image, the accumulated differential image or the setpoint image can be transmitted at random to the Forth processor via the pipeline bus 94. Selection is effected via a status register in the address controller 104 which is loaded via the AT bus 96. The synchronization of the address controller 104 used for address generation and for memory management is effected by the signals made available on the control lines 98. The selection of the operating modes is effected via a control register. The address controller 104 continually guarantees the refreshing of the memories 100–103.

With the aid of the LUTs 105, 106, the current differential image and the accumulated differential image are evaluated during image inspection as a function of the parameter-image data in the parameter-image memory 102 and as a function of the absolute brightness. On the basis of the data resulting at the outputs of the LUTs 105, 106, the evaluation circuit 107 assigns error classes to the differential-image data. The error data are stored in the memory module 108 for documentation and statistics. If the magnitude of the differential image exceeds a predetermined limit value, then the evaluation circuit 107 issues an error message via the AT bus 96. For this purpose, an address generator inside the evaluation circuit 107, parallel to the address controller 104, generates a coarse grid, which makes it easier to locate the site of the error. The site of the error and the type of error are stored in the memory module 108.

The parameter-image memory 102 contains the control information on the processing of each individual pixel.

The data in the setpoint-image memory 100 can be used, with the aid of this control information, to reduce a required non-linear characteristic for error evaluation. Contained for this purpose in the parameter memory 102 are the following parameters: parameters for the edge markings; a weighting function for the definition of the weighting of image errors in the inspection process; measured colour values for a marked pixel, said values being stored in a pointer-controlled list; and the shading measuring points and calibration points of the CCD sensors 82. The image size including the side limits is set by setting bits for the edge markings. The parameters for the weighting function represent a measure for the assessment of errors. This makes it possible for errors in homogeneous regions of the printed image to be weighted more heavily than errors at contours in the printed image. A grey-value-dependent control is employed, with the result that, via the LUTs 105, 106, the calorimetric values $x^*$, $y^*$, $z^*$ and $i^*$ are formed for image inspection. The parameter expressed by the weighting function is used in the address controller 104 for the selection of characteristics. Through the intermediary of a table, it is possible, with the aid of the evaluation circuit 107, for errors to be assigned to various error classes, it being possible for the errors to be evaluated into individual classes along the lines of an error histogram.

Via a separate control line 109, the data controller 99 outputs a bit ENC for the control of colour measurement. The pixels determined for colour measurement are entered in a list in the sequence of their scanning, with the result that, after further processing of the measured image data by the Forth processor, they can be transmitted as measured colour values. For shading measurement, the bit ENC is set in a selected, non-printed measuring line, with the result that the measurement of the paper white value of the web 2 is performed simultaneously. These measured values are likewise formatted as list data. The further processing, particularly the accumulation and the loading of the shading values, is performed likewise by the Forth processor. Provided for the calibration of the absolute sensitivity of the CCD sensors 82 and the colour temperature of the associated light sources 21, 22 or 78 is a special element of a CCD line, which special element is likewise loaded into the list memory by the set bit ENC and is thus available to the further evaluation process.

List of reference characters

| | |
|---|---|
| 1 | Driving element |
| 2 | Web |
| 3, 4 | Printing unit |
| 5 | Rotary printing press |
| 6, 7, 8, 9 | Ink-distribution apparatus |
| 10 | Transport direction |
| 11, 12, 13, 14 | Blanket cylinder |
| 15, 16 | Image-recording apparatus |
| 17, 18 | Bearing |
| 19, 20 | Guide |
| 21, 22 | Light source |
| 23, 24 | Photoelectric receiver |
| 25 | Rotary-position sensor |
| 26, 27, 28, 29 | Register-adjusting devices |
| 30 | Printing-press control system |
| 31 | Operator desk |
| 32 | Input and output points |
| 33 | Closed-loop control circuit |
| 34 | Apparatus for the conditioning of the image signals |
| 35 | Comparator |
| 36 | Reference-variable transmitter |
| 37 | Closed-loop control apparatus |
| 38 | Error-detection logic circuit |
| 39 | Computer |
| 40 | Screen |
| 41 | Keyboard |
| 42 | Cursor-control device |
| 43 | Image-measuring apparatus |
| 44 | Network |
| 45 | Data-communication modem |
| 46 | Transmitting/receiving unit |
| 47 | Acoustic signal generator |
| 48, 49, 50, 51 | Imaging system |
| 52, 53, 54, 55 | Filter |
| 56, 57, 58, 59 | CCD sensors |
| 60 | Adjusting elements |
| 61 | Optically imaging system |
| 62, 63, 64, 65 | Colour filter |
| 66 | Protective lens |
| 67 | CCD lines |
| 68 | Adjusting elements |
| 69 | Image elements |
| 70 | Lens array |
| 71 | Colour filter |
| 72 | Image conductor |
| 73 | Optically imaging system |
| 74 | CCD sensor |
| 75 | Adjusting elements |
| 76 | Cylinder |
| 77 | Receiver modules |
| 78 | Light source |
| 79 | Apparatus for light-quantity regulation |
| 80 | Synchronizing apparatus |
| 81 | Incremental sensor |
| 82 | CCD sensor |
| 83 | Amplifier |
| 84 | Sample & hold element |

-continued

| List of reference characters | |
|---|---|
| 85 | Analogue-digital converter |
| 86 | Processing unit |
| 87 | Correction element |
| 88 | Accumulation unit |
| 89 | Vertical-format buffer |
| 90 | Timer |
| 91 | List memory |
| 92, 93 | Multiplier |
| 94 | Pipeline bus |
| 95 | Colour-value controller |
| 96 | AT bus |
| 97 | Memory module |
| 98 | Control lines |
| 99 | Data controller |
| 100 | Setpoint-image memory |
| 101 | Differential-image memory |
| 102 | Parameter-image memory |
| 103 | Accumulated differential-image memory |
| 104 | Address controller |
| 105, 106 | Look-up-table modules |
| 107 | Evaluation circuit |
| 108 | Memory module |
| 109 | Control line |
| 110 | Data memory |

We claim:

1. Method for controlling operating steps of a printing press, which comprises:

providing at least one image-recording device for generating image signals from at least one surface of at least one printed product, the at least one printed product being defined as an actual printed image;

providing a processing device for receiving the image signals from the image-recording device, the processing device generating signals for controlling the operating steps of a printing press;

automatically determining coordinates of measurement sites for the image-recording device from image information reproducing the at least one surface of the printed product, the determined coordinates being for measurement sites for obtaining actual measured color values for controlling an ink-distribution device of a printing press; and providing control signals from the processing device to a printing unit of the printing press to control an ink layer thickness on the at least one printed product.

2. Method according to claim 1, which includes, with the image-recording device, scanning the surface of a device for transporting the printed product in relation to the image-recording device, in addition to scanning all of the surface of the printed product.

3. The method according to claim 1, which comprises:

at start-up of the printing press, obtaining actual values from measurement sites in a color-control strip produced during printing;

controlling the ink-distribution device with prescribed setpoint values during the startup of the printing press until an okay condition is reached at which time an operator of the printing press sends an okay signal to an open-loop or closed-loop control device; and starting from the sending of the okay signal, obtaining actual values from measurement sites in the printed image.

4. Method according to claim 1, which includes determining from the image information coordinates for measurement sites for obtaining actual measured dampening-solution values for controlling a dampening-solution distribution device of an offset printing press.

5. Device for controlling a printing press, comprising:

at least one image-recording device directed to a surface of a printed product, the printed product being defined as an actual printed image;

a control circuit being connected to said image-recording device, said control circuit receiving image information reproducing the surface of the printed product from said image-recording device; and actuators controlled by said control circuit being connected within a printing press for controlling printing cylinders to correct printing errors.

6. Device according to claim 5, wherein said image-recording device is directed over the entire width thereof to the surface of the printed product, and including a plurality of in-line image sensors for respectively scanning a zone.

7. The device according to claim 6, wherein said image-recording device is adaptable to scan over a variable width of the surface of the printed product.

8. Device according to claim 6, wherein said zone to be scanned is defined by an ink-distribution device of a printing press.

9. Device according to claim 5, including an incremental rotary-position sensor for speed measurement coupled to a rotating cylinder for transporting the printed product.

10. Device according to claim 9, wherein the control circuit is of the closed-loop type, and wherein said rotary-position sensor is connected to a timer disposed in said closed-loop control circuit, said timer being connected to a circuit for varying the integration time of CCD sensors associated with said image-recording device.

11. The device according to claim 5, wherein said control circuit is a closed-loop control circuit, and including an input device for interactively sending actuating signals by a press operator to said closed-loop control circuit and an arrangement for evaluating time intervals and magnitudes of said actuating signals and for introducing instantaneously existing actual values for said time intervals and/or said magnitudes defined as setpoint values when said actual values fall below threshold values for said time intervals and/or said magnitudes, said actuating signals and said control circuit providing zonal control signals to a printing unit of the printing press to control an ink layer thickness on the printed product.

12. The device according to claim 5, wherein said control circuit is a closed-loop control circuit, and said closed-loop control circuit provides zonal control of the layer thickness of the printing ink and is associated with an error-detection logic circuit supplied with conditioned actual image signals, a comparison device connected to said error-detection logic circuit for supplying said error-detection logic circuit also with output signals of said comparison device, and a monitor screen connected to said closed-loop control circuit for outputting error type and time of occurrence alphanumerically thereon.

13. The device according to claim 12, wherein said error-detection logic circuit transmits an output signal to block output of signals to said actuators.

14. Method for controlling operating steps of a printing press, which comprises:

providing at least one image-recording device for generating image signals from at least one surface of at least one printed product, the at least one printed product being defined as an actual printed image and not a registration mark;

providing a processing device for receiving the image signals from the image-recording device, the processing device generating signals for controlling the operating steps of a printing press;

automatically determining coordinates of measurement sites for the image-recording device from image information reproducing the at least one surface of the printed product; and providing control signals from the processing unit to a printing unit to control an ink layer thickness on the at least one print material.

* * * * *